US008538307B2

(12) United States Patent
Hisano

(10) Patent No.: US 8,538,307 B2
(45) Date of Patent: Sep. 17, 2013

(54) FIXING DEVICE

(75) Inventor: Masato Hisano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 13/403,498

(22) Filed: Feb. 23, 2012

(65) Prior Publication Data

US 2012/0163887 A1 Jun. 28, 2012

Related U.S. Application Data

(63) Continuation of application No. PCT/JP2010/065882, filed on Sep. 8, 2010.

(30) Foreign Application Priority Data

Sep. 8, 2009 (JP) ..... 2009-207102

(51) Int. Cl.
*G03G 15/20* (2006.01)

(52) U.S. Cl.
USPC ..... 399/328; 399/67

(58) Field of Classification Search
USPC ..... 399/67, 167, 328–331
See application file for complete search history.

(56) References Cited

U.S. PATENT DOCUMENTS

| | | | | |
|---|---|---|---|---|
| 8,099,034 | B2 * | 1/2012 | Tsukamoto et al. | 399/328 |
| 2010/0021208 | A1 * | 1/2010 | Tomatsu | 399/222 |

FOREIGN PATENT DOCUMENTS

| | | | |
|---|---|---|---|
| JP | 7-129018 | A | 5/1995 |
| JP | 2000-122460 | A | 4/2000 |
| JP | 2003-280308 | A | 10/2003 |
| JP | 2007-025349 | A | 2/2007 |

OTHER PUBLICATIONS

Oct. 12, 2010 Notification of Transmittal of the International Search Report and the Written Opinion of the International Searching Authority, or the Declaration (PCT/IDS/220), Oct. 12, 2010 International Search Report (PCT/ISA/210), and Oct. 12, 2010 Written Opinion of the International Searching Authority (PCT/ISA/237). International Search Report dated Oct. 12, 2010, in PCT/JP2010/065882.

* cited by examiner

*Primary Examiner* — Hoang Ngo
(74) *Attorney, Agent, or Firm* — Fitzpatrick, Cella, Harper & Scinto

(57) ABSTRACT

A fixing device includes a film, a roller forming a nip with the film, for conveying a sheet while nipping the sheet, a member for urging one of the film and the roller toward the other, a heater for heating one of the film and the roller, a cam, rotationally driven by a motor, for moving the urging member in a releasing direction or a restoring direction of an urging force by the urging member, a gear that swings, depending on normal or reverse rotation of the motor, and a stopper to stop the swinging of the gear. By this arrangement, the rapid rotation of gears that are free from engagement, which can cause impact noise during a transitional process between a gear engagement state in a nip-released state by the roller and a gear engagement state during a nipping function by the roller, can be suppressed.

5 Claims, 10 Drawing Sheets

FIXING DEVICE

TECHNICAL FIELD

The present invention relates to a fixing device (fixing apparatus) mounted in an image forming apparatus, using an electrophotographic type or an electrostatic recording type, such as a copying machine, a laser beam printer or a facsimile machine.

BACKGROUND ART

The image forming apparatus such as an electrophotographic apparatus or an electrostatic recording apparatus forms a toner image on a recording material and fixes thus toner image by heating and pressing the toner image to form an image. As a type of the fixing device used in such an image forming apparatus, a roller fixing type in which a pressing roller is press-contacted to a fixing roller including a heater therein to form a fixing nip and effects fixing has been conventionally employed. An example of such an image forming apparatus including the fixing roller and the pressing roller is described in Japanese Laid-Open Patent Application (JP-A) Hei 7-129018.

The image forming apparatus described in JP-A Hei 7-129018 includes a motor for driving the fixing device or the like. When this motor is reversely rotated, a pendulum gear and an inner gear having partly omitted teeth are engaged with each other by gears and a pendulum arm, so that the gears are rotated. Then, a gear set so as to rotate together with the gear having partly omitted teeth with a predetermined reduction ratio and thereby a mangle gear is rotationally moved and a nip is released by a torsion bar. Contrary to this, in the case where removal of the recording material is detected by a sensor arm, the motor is rotated in a normal direction to return the torsion bar in a reverse procedure, so that the nip is returned to an original state. According to such a constitution, release and restoration of the nip between the fixing roller and the pressing roller can be effected.

However, in JP-A Hei 7-129018, also after the fixing pendulum is swung in the reverse direction, an external gear 15*i*, a gear 15*k* and a mangle gear 30 are continuously rotated. In this case, in a no-load state in which these gears do not receive a driving force of the fixing pendulum, the external gear 15*i*, the gear 15*k* and the mangle gear 30 are continuously rotated rapidly and then are abruptly stopped when a balance is achieved. In a period from this rapid rotation to the abrupt stop, impact noise is generated. That is, in the case where a gear engagement state is transferred from a nip-released state by the pressing roller to a nip-functioning state by the pressing roller, the gears free from the engagement are rotated rapidly, so that the impact noise is generated.

A problem of the present invention is to provide a fixing device capable of suppressing a phenomenon such that the gears free from the engagement are rotated rapidly, during the transition between the gear engagement state in the nip-released state by the pressing roller and the gear engagement state in the nip-functioning state by the pressing roller, to generate the impact noise.

DISCLOSURE OF THE INVENTION

The present invention for solving the above-described problem is a fixing device comprising: a rotatable member for conveying a recording material for carrying an image; a back-up member for forming a fixing nip, together with the rotatable member, in which the image is to be fixed on the recording material; a pressure-applying mechanism for applying pressure to the fixing nip; a cam for releasing the pressure applied to the fixing nip by acting on the pressure-applying mechanism; a motor, capable of rotating normally and reversely, for driving the cam; a first power transmitting path for permitting transmission of power of the motor; a second power transmitting path for permitting transmission of the power of the motor; a swingable gear for transmitting the power of the motor to the first power transmitting path or the second power transmitting path; a swingable arm for holding the swingable gear; and a preventing member for preventing movement of the swingable arm by being engaged with the swingable arm, wherein of the first power transmitting path and the second power transmitting path, at least the first power transmitting path is a path for permitting transmission of the power of the motor to the cam, wherein when the motor rotates in one direction, the swingable arm is tilted so that the swingable gear is moved to a first position for permitting transmission of the power of the motor to the first power transmitting path, and when the motor rotates in the other direction, the swingable arm is tilted so that the swingable gear is moved to a second position for permitting transmission of the power of the motor to the second power transmitting path, and wherein when the swingable gear is located at the first position, the preventing member engages with the swingable arm so that the swingable gear is prevented from moving from the first position, and when the swingable gear is located at the second position, the preventing member is spaced from the swingable arm.

Figure 2:
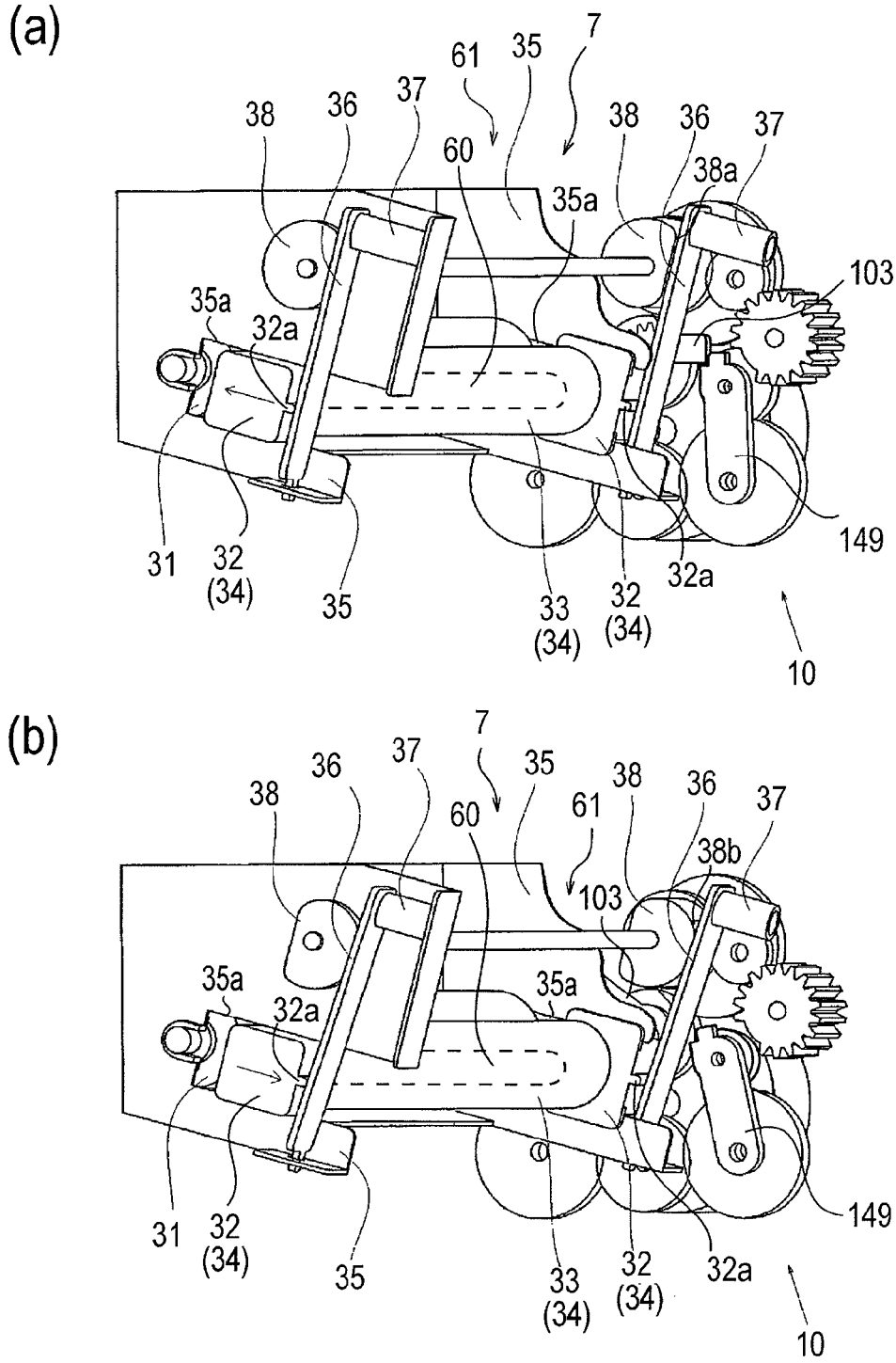

Parts (a) and (b) of FIG. 2 are partly enlarged perspective views showing a structure of a fixing device.

Figure 3:
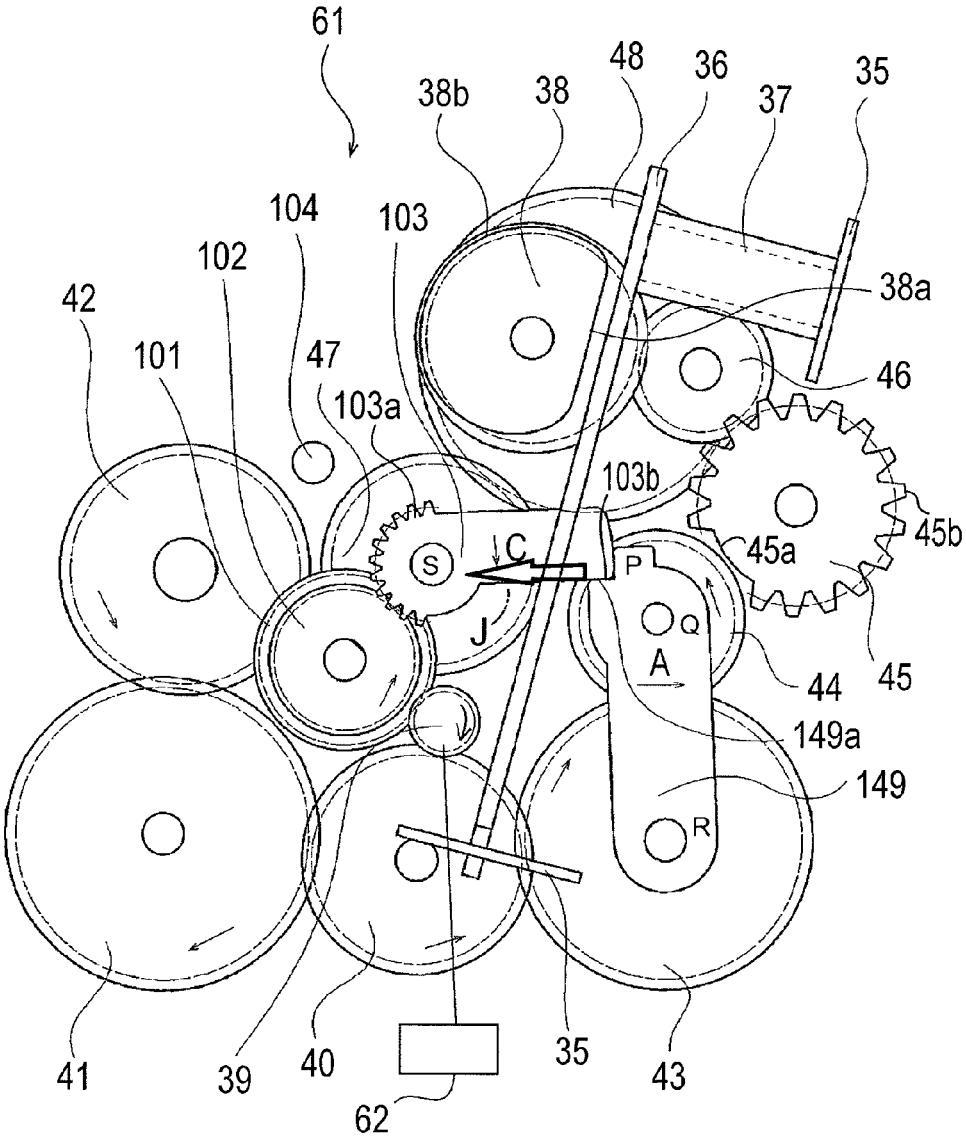

FIG. 3 is an enlarged side view showing a structure of a pressing and (pressure-)releasing mechanism.

Figure 4:
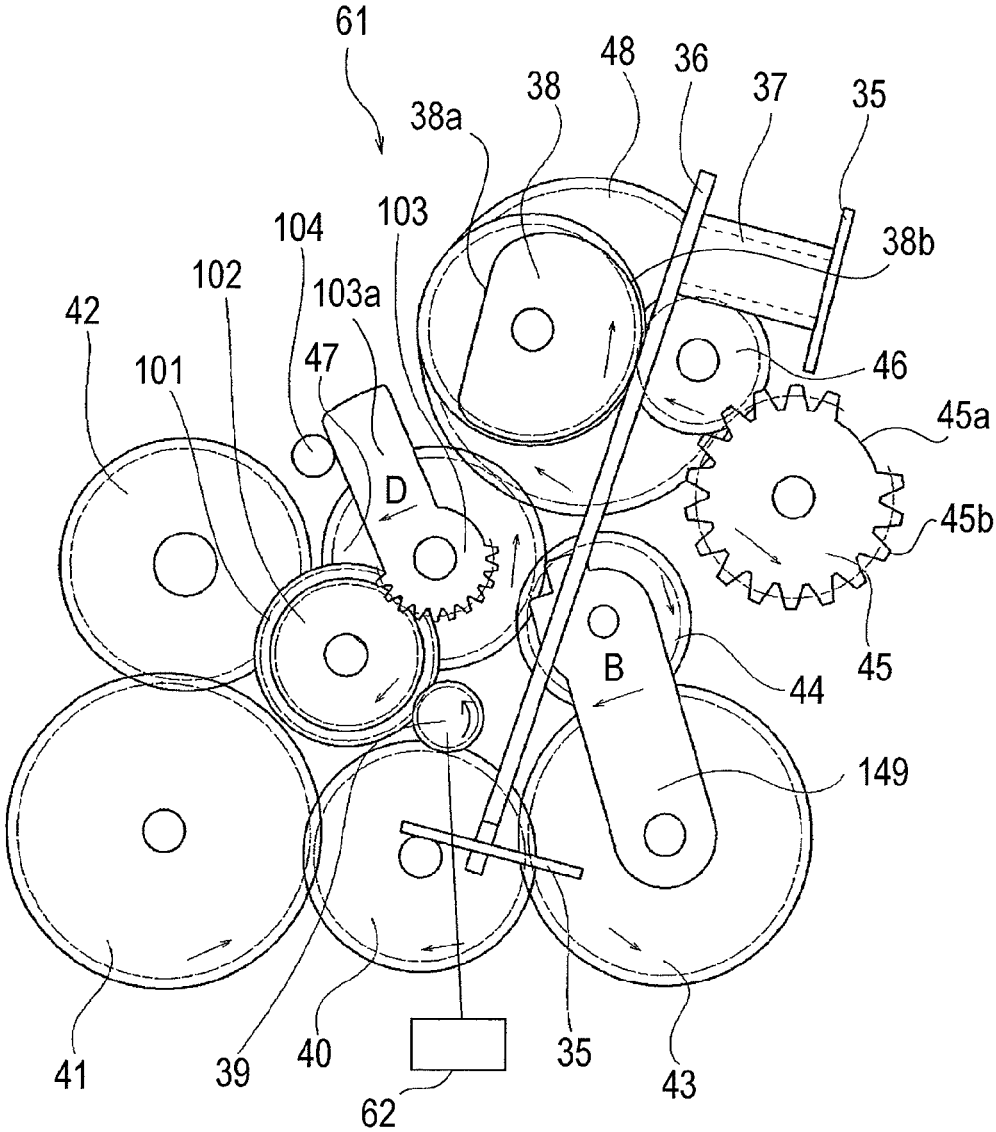

FIG. 4 is an enlarged side view showing the structure of the pressing and releasing mechanism.

Figure 5:
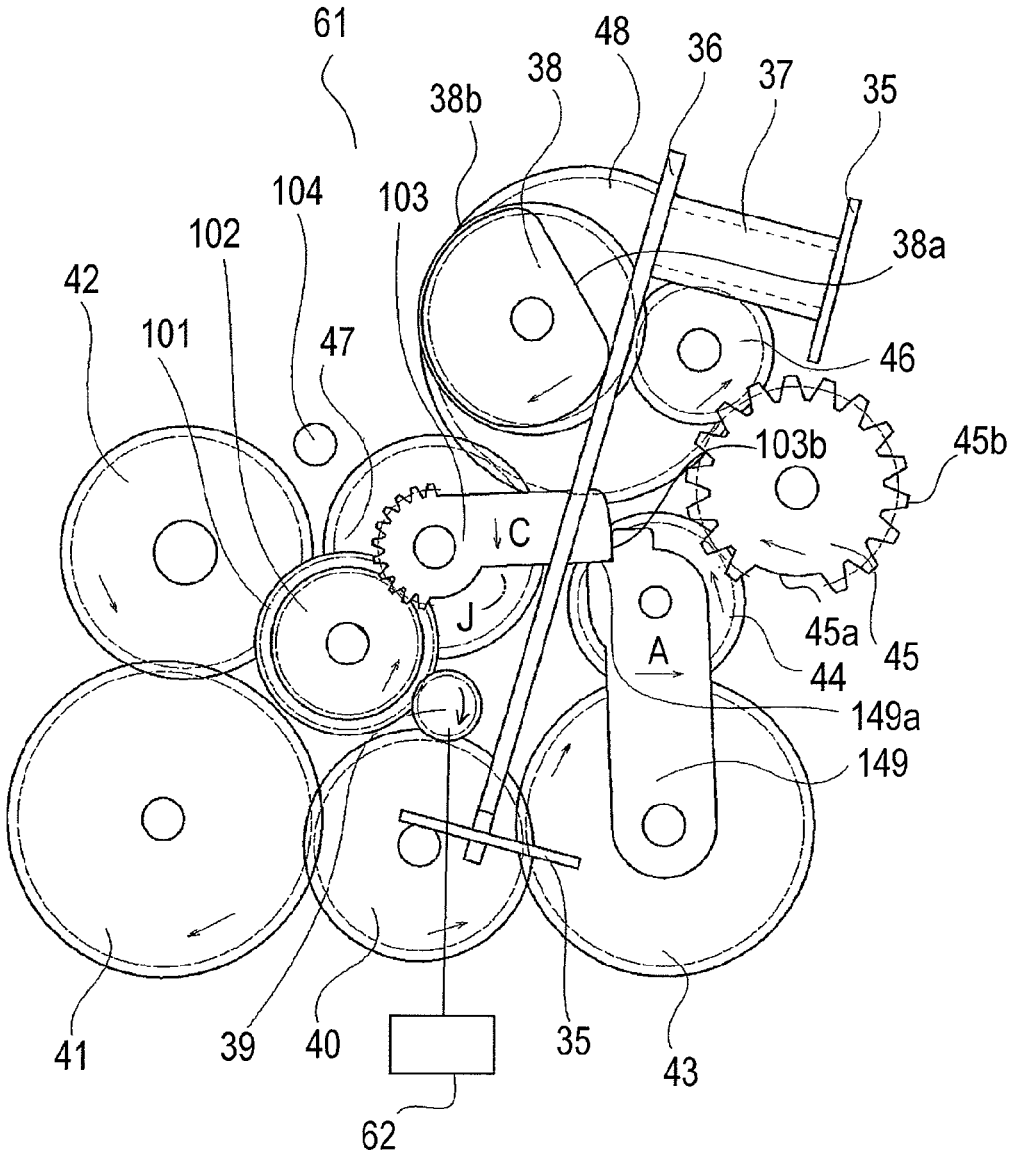

FIG. 5 is an enlarged side view showing the structure of the pressing and releasing mechanism.

Figure 6:
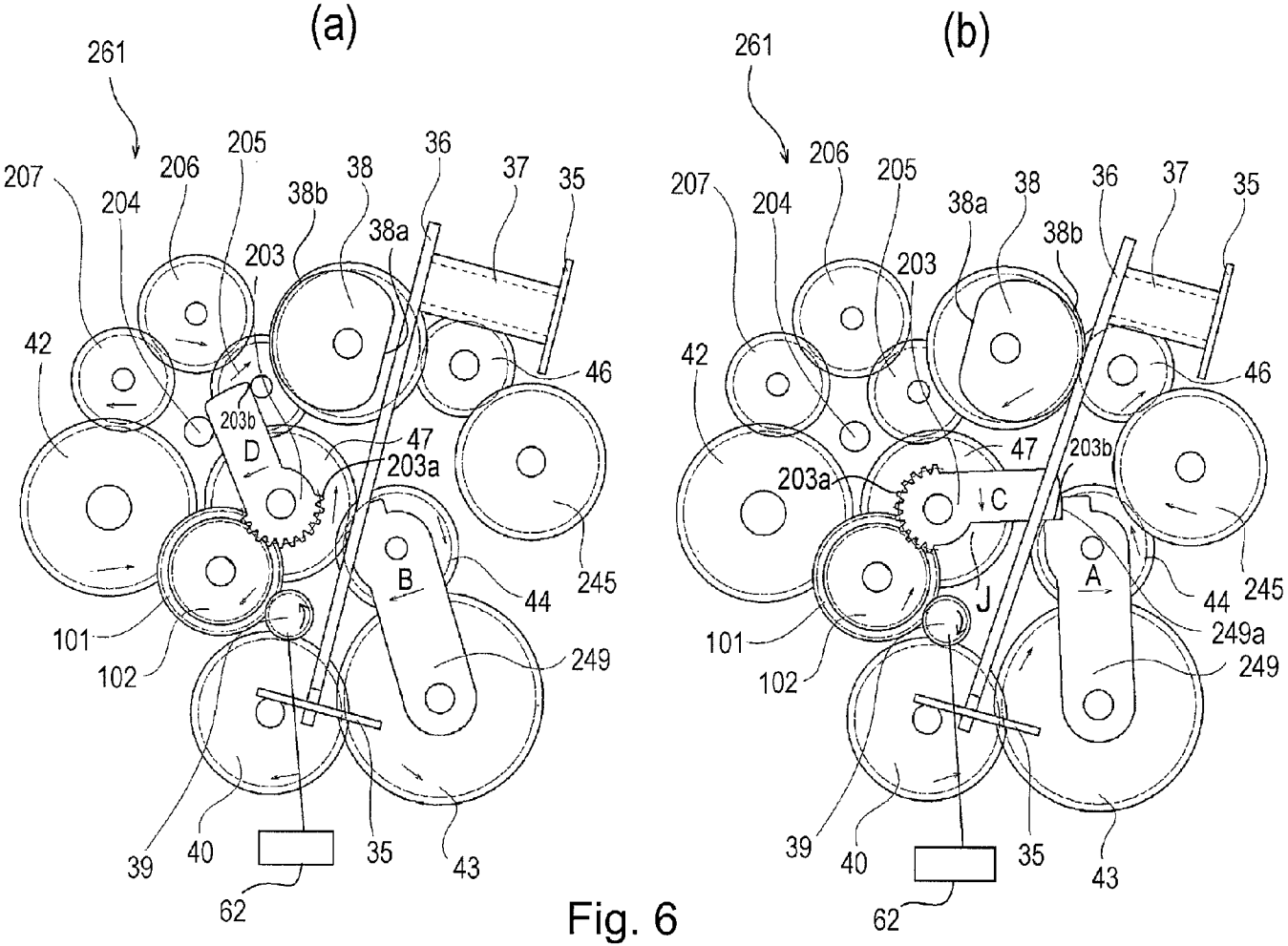

Parts (a) and (b) of FIG. 6 are side views showing a pressing and releasing mechanism provided in a fixing device according to Embodiment 2 of the present invention.

Figure 7:
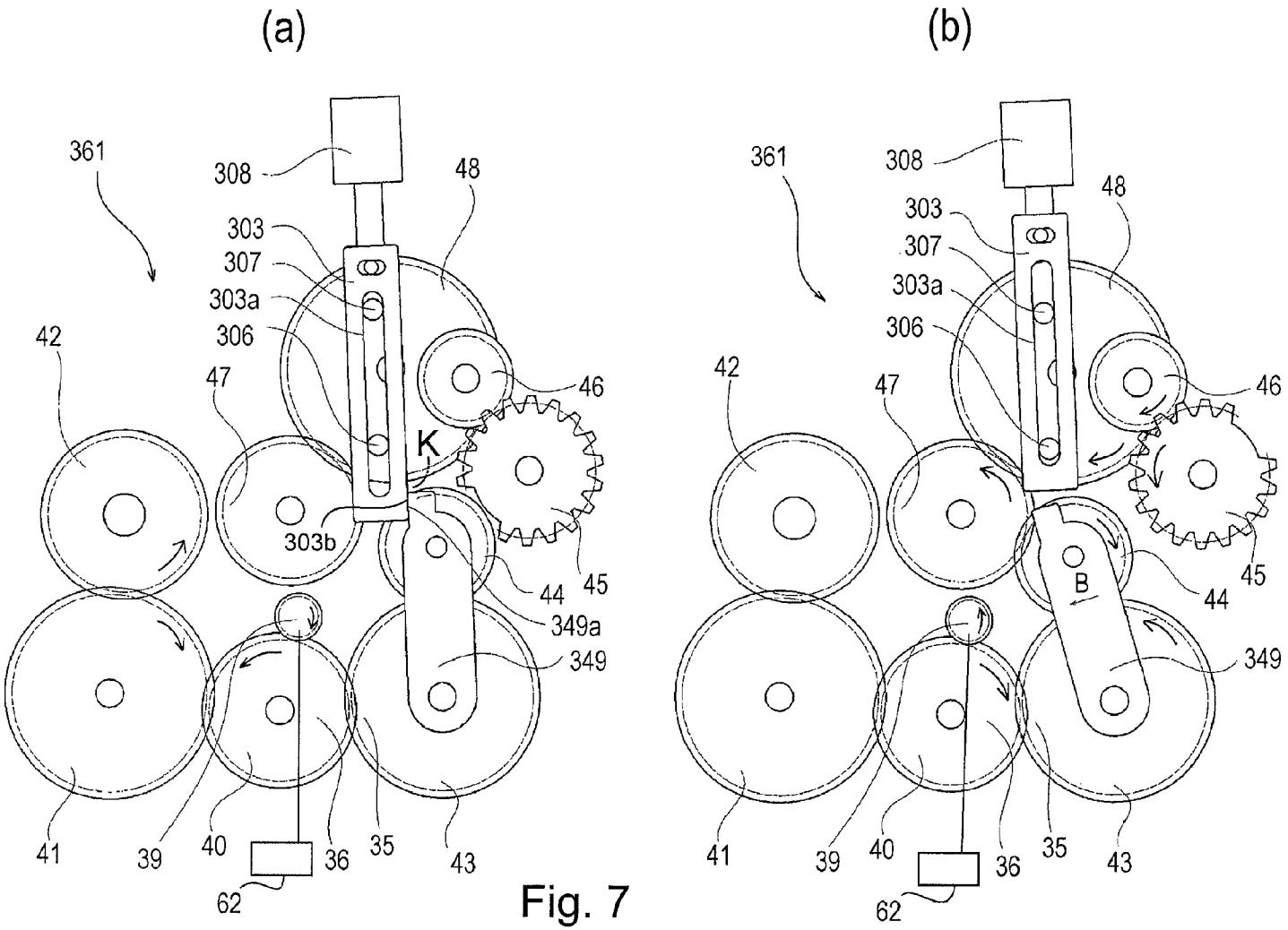

Parts (a) and (b) of FIG. 7 are side views showing a structure in which a part of mechanisms such as a cam is removed from a pressing and releasing mechanism provided in a fixing device according to Embodiment 3 of the present invention.

Figure 8:
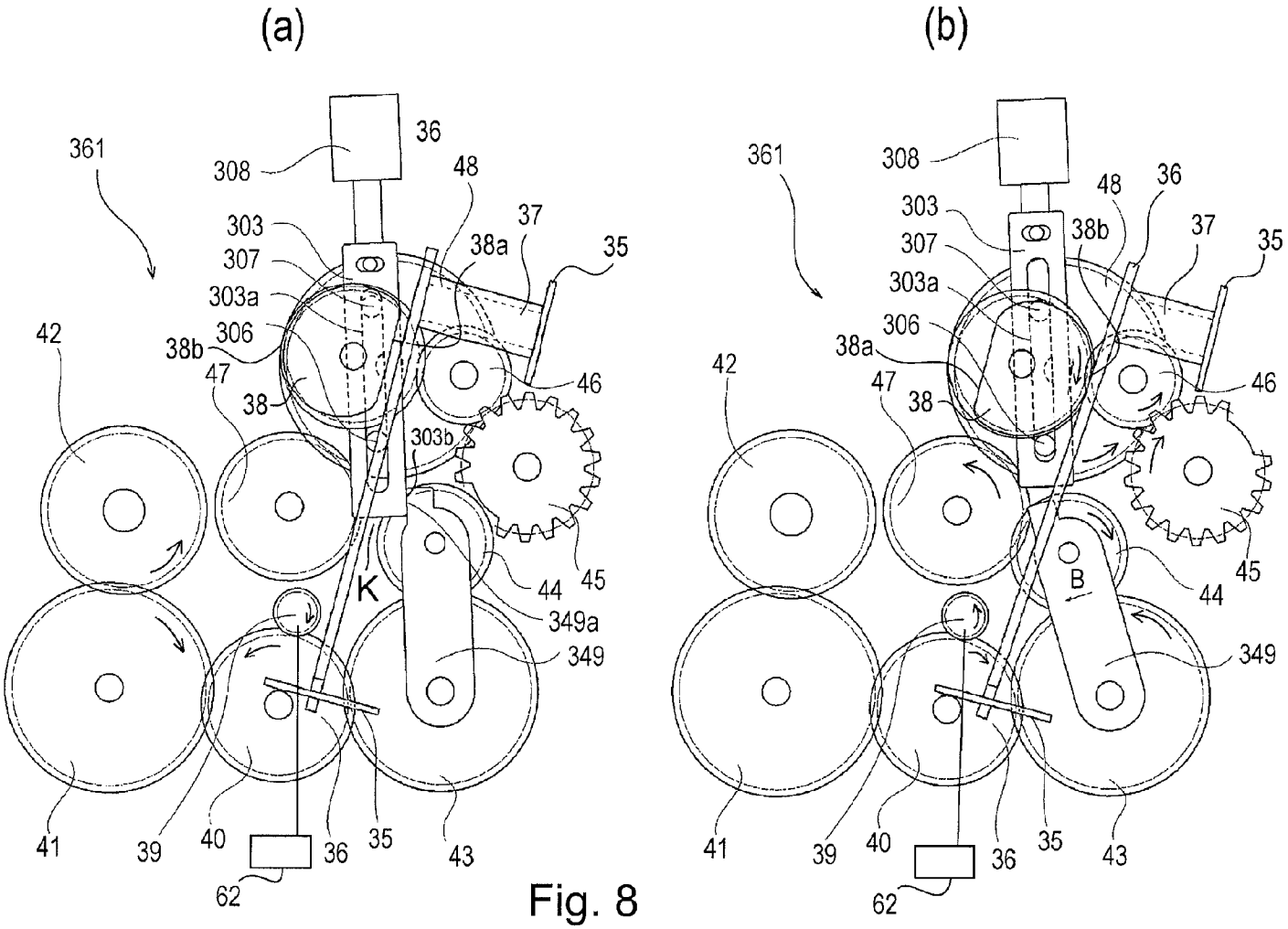

Parts (a) and (b) of FIG. 8 are side views showing the structure.

Figure 9:
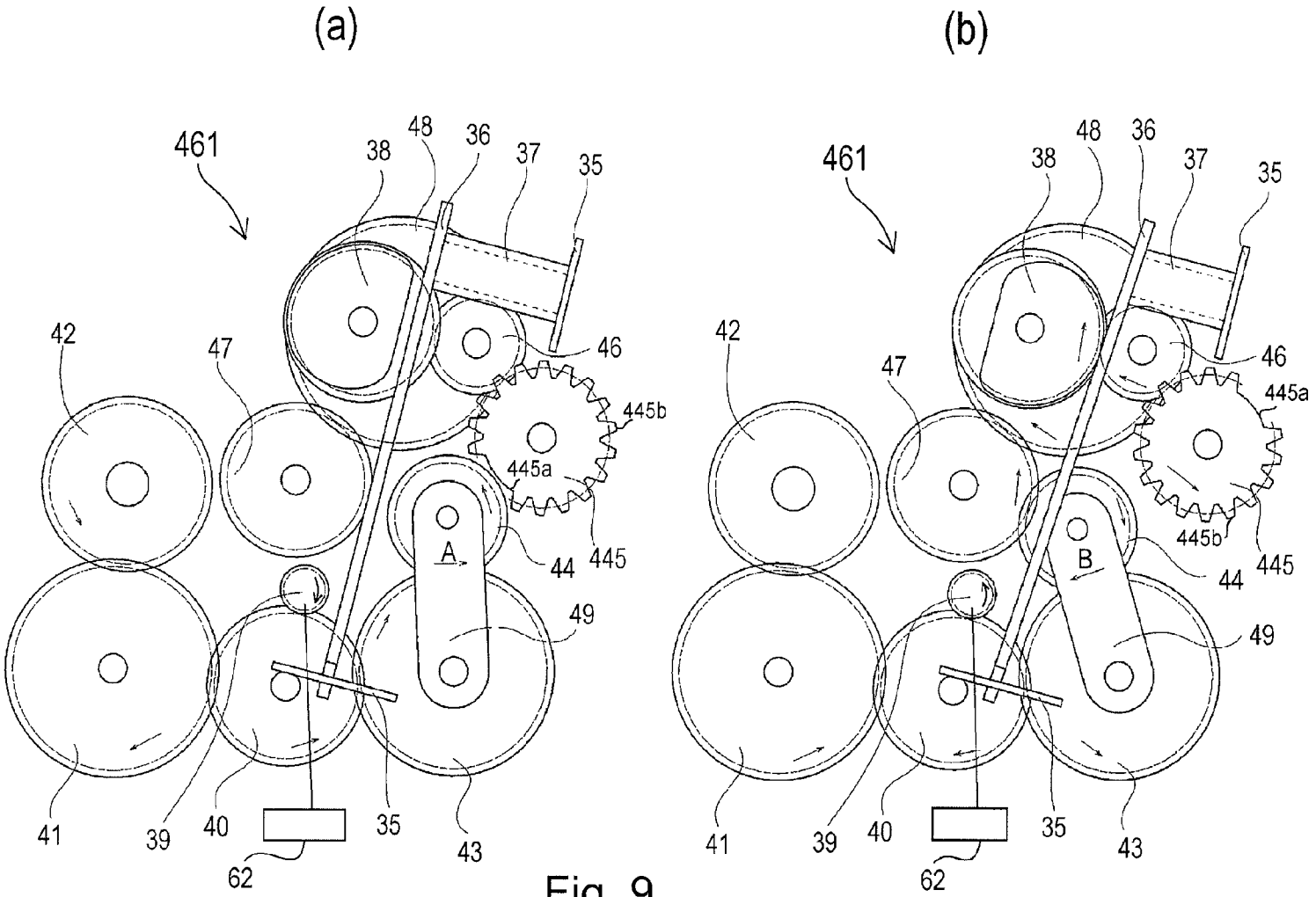

Parts (a) and (b) of FIG. 9 are side views showing a structure of a pressing and releasing mechanism provided in a fixing device according to a comparative embodiment.

Figure 10:
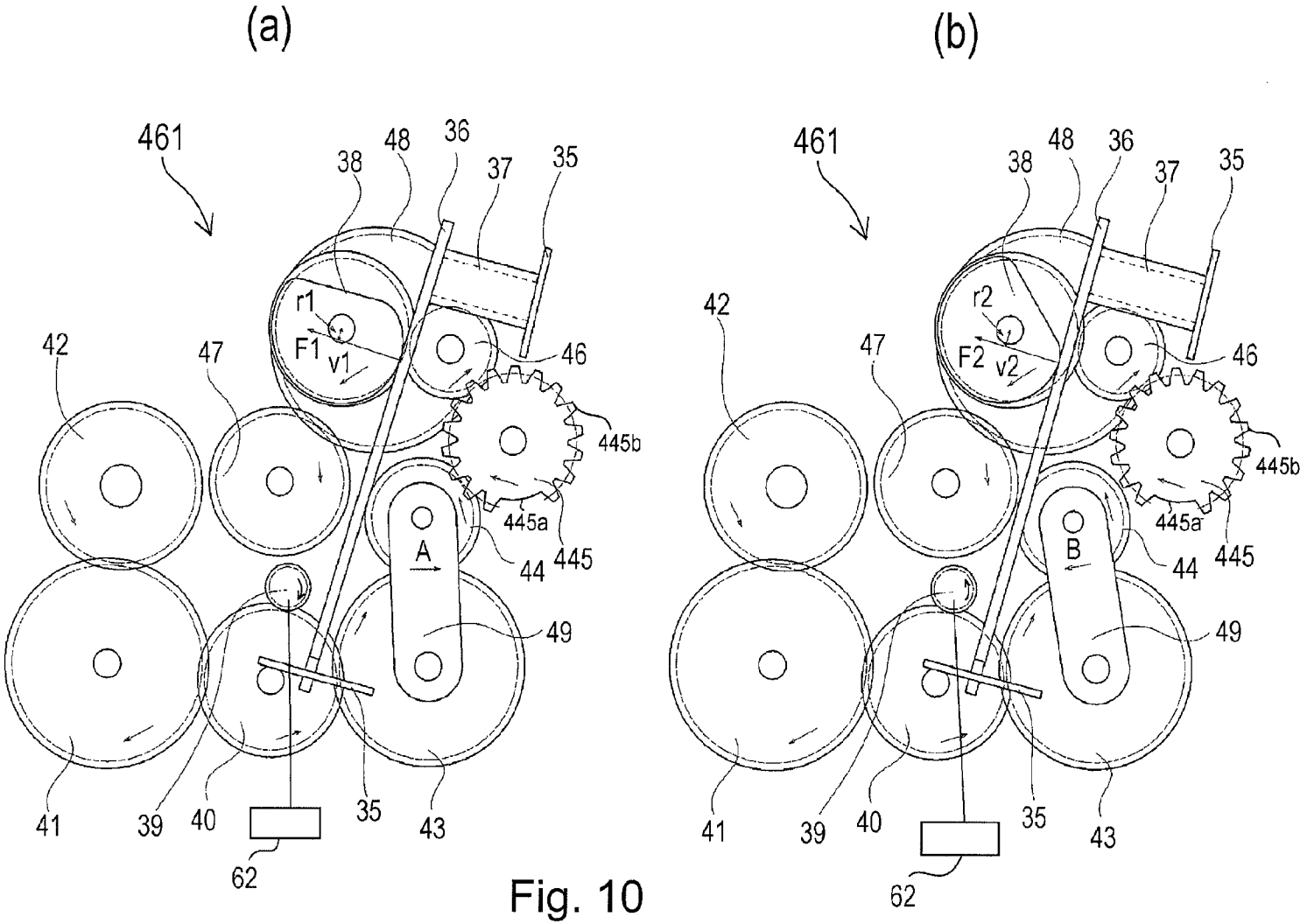

Parts (a) and (b) of FIG. 10 are side views showing the structure of the pressing and releasing mechanism provided in the fixing device according to the comparative embodiment.

BEST MODE FOR CARRYING OUT THE INVENTION

Hereinbelow, with reference to the drawings, preferred embodiments of the present invention will be exemplarily described specifically. However, dimensions, materials, shapes and relative positions of constituent elements described in the embodiments are appropriately changed depending on structures and various conditions of apparatuses to which the present invention is applied and therefore the scope of the present invention is not intended to be limited thereto unless otherwise particularly specified.

Embodiment 1

Figure 1:
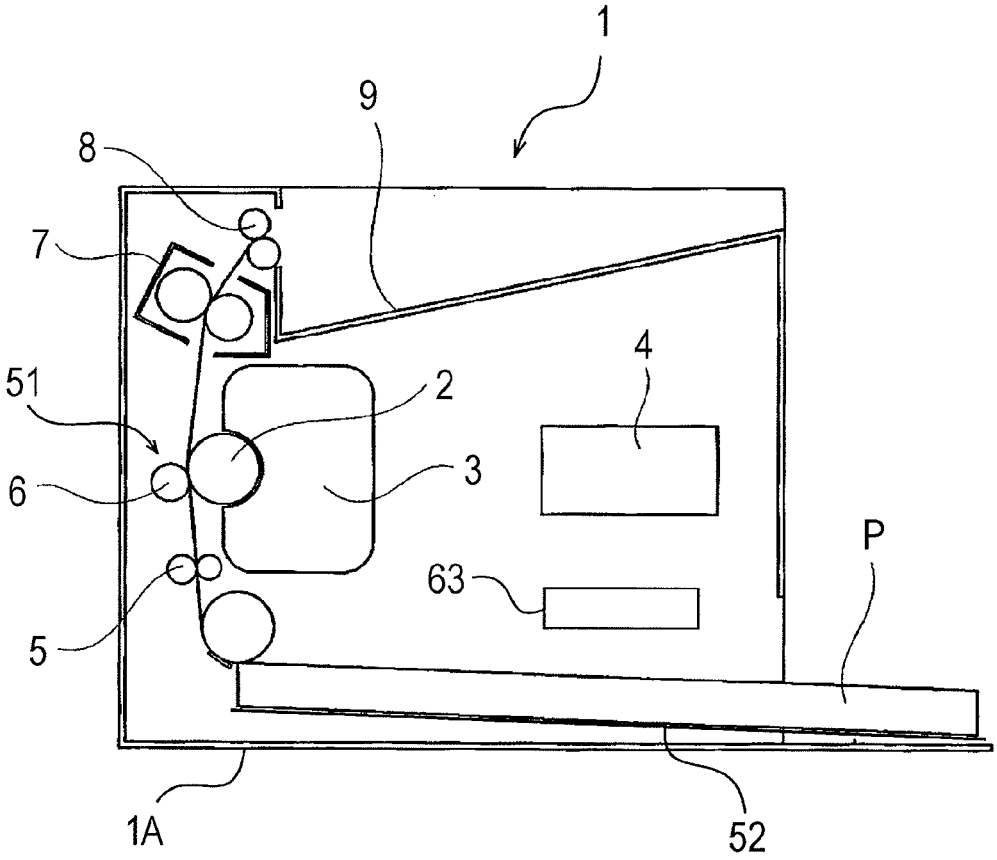
FIG. 1 is a sectional view showing a structure of an image forming apparatus according to Embodiment 1 of the present invention.

FIG. 1 is a sectional view showing a structure of an image forming apparatus 1 according to Embodiment 1 of the present invention. The image forming apparatus 1 is a laser beam printer using an electrophotographic image forming process. As shown in FIG. 1, the image forming apparatus 1 includes an image forming apparatus main assembly (hereinafter simply referred to as an "apparatus main assembly") 1A and inside this apparatus main assembly, an image forming portion 51 which is an "image forming means" for forming an image on a sheet which is a "recording material (medium)" is provided. The image forming portion 51 includes a photosensitive drum 2 which is an "image bearing member" and a transfer roller 6 which is a "transfer device", and the like.

At least the photosensitive drum 2 is included in a process cartridge 3 and has a constitution to be incorporated into the apparatus main assembly as the process cartridge 3. Inside the apparatus main assembly 1A, a laser scanner scanning optical system 4 is incorporated and an electrostatic image is formed on a surface of the photosensitive drum 2 by this laser scanner scanning optical system 4. In the case of the "image forming means" or the "image forming portion", this is a concept at least including the photosensitive drum 2 and may also be a concept integrally encompassing other members such as the transfer roller 6, an unshown developing device for forming a toner image on the photosensitive drum 2, and an unshown cleaner, and the like.

Next, with respect to the constitution (structure) of the image forming apparatus 1, a schematic structure will be described along a sheet P. The sheet P separated and fed one by one from a sheet-feeding tray 52 is conveyed by a registration roller pair 5. Onto the sheet P, the toner image on the photosensitive drum 2 is transferred by the transfer roller 6. Thereafter, the sheet P is heated and pressed by a fixing device 7. On the sheet P, the toner image is fixed. The sheet P is discharged on a discharge tray 9 by an upper sheet-discharging roller 8. Inside the apparatus main assembly 1A, a controller 63 which is a "controller means" for controlling drive of respective devices is provided.

Parts (a) and (b) of FIG. 2 are partly enlarged perspective view showing a structure of the fixing device 7. Part (a) of FIG. 2 shows a state in which a fixing film 33 is urged against a pressing roller 31. Part (b) of FIG. 2 shows a state in which the fixing film 33 is not urged against the pressing roller 31. The fixing film 33 is rotatably supported by a frame 35. For convenience of illustration, in (a) of FIG. 2 and (b) of FIG. 2, with respect to the frame 35, only a part thereof is illustrated and other portions thereof are illustrated in a cut state.

First, as shown in (a) of FIG. 2, the fixing device 7 includes the fixing film 33. Further, the fixing device 7 includes the pressing roller 31 which is a "rotatable member", which forms a fixing nip in contact with the fixing film 33, for conveying the sheet P which is the "recording material" in the nip while nipping the sheet P. Inside the fixing film 33, a heater 60 which is a "heating means" is provided. However, inside at least one of the fixing film 33 and the pressing roller 31, the heater 60 which is the "heating means" for heating at least one of the fixing film 33 and the pressing roller 31 may only be required to be provided. At each of both end portions of the fixing film 33, a holder 32 for holding the fixing film 33 is disposed. With respect to the holder 32, the fixing film 33 is slidable. With respect to these fixing film 33 and pressing roller 31, these members are referred to as a fixing film unit 34 in the following description.

Further, the fixing device 7 includes an urging member 36 for urging one of the fixing film 33 and the pressing roller 31 toward the other. On the urging member 36, a pressing spring 37 is fixed. The urging member 36 and the pressing spring 37 constitute a pressure-applying mechanism. By an urging force of the urging member 36, the urging member 36 urges the fixing film unit 34 in a direction toward the pressing roller 31. Thus, the fixing nip is formed between the fixing film 33 and the pressing roller 31, and the sheet P on which an unfixed toner image is transferred passes through the nip. During the passing, the sheet P is heated and pressed, so that the unfixed toner image is fixed on the surface of the sheet P.

At the surface of the fixing film 33, in order to obtain a god fixability of the unfixed toner image, an elastic layer of a rubber or the like is provided. Here, when the fixing film 33 and the pressing roller 31 are left standing in a state in which they are press-contacted as they are, there was a possibility that elastic layers at the surfaces of the fixing film 33 and the pressing roller 31 are deformed.

Further, the sheet P was clogged during the passing thereof through the nip between the fixing film 33 and the pressing roller 31 to cause a jam in some cases. In the case where the jammed sheet position is pulled out, when the fixing film 33 and the pressing roller 31 are kept in the press-contact state, a frictional load is large and therefore the sheet P is not easily removed, so that there was also a possibility that the sheet P is torn and remain at the inside of the apparatus main assembly (FIG. 1).

In order to solve such problems, a cam 38 is rotated so that the surface state of the cam 38 can be transferred from a state in which a flattened surface 38*a* of the cam 38 is disposed in parallel to the urging member 36 ((a) of FIG. 2) to a state in which a projection-like portion 38*b* of the cam 38 abuts against the urging member 36 ((b) of FIG. 2). By such a constitution for releasing the pressure application (urging), in the fixing device 7, the above-described deformation of the elastic layer 4*s* of the fixing film 33 and the pressing roller 31 is prevented, so that the jammed sheet P is easily cleared. An inner pressing and releasing mechanism 61 of such a fixing device 7 will be described specifically below.

The pressing and releasing mechanism 61 presses, in the case of the state shown in (a) of FIG. 2, the fixing film 33 against the pressing roller 31. That is, in the case of the state in which the flattened surface 38*a* of the cam 38 is parallel to the urging member 36, the urging member 36 which receives an urging force of the pressing spring 37 urges a projected portion 32*a* formed on the holder 32 in a direction toward the pressing roller 31. The holder 32 is supported by the frame 35 so that it is movable in the direction toward the pressing roller 31 along an inducing hole 35*a* formed in the frame 35.

Further, the pressing and releasing mechanism 61 retracts, in the case of the state shown in (b) of FIG. 2, the fixing film 33 from the pressing roller 31. That is, in the case where the cam 38 is rotated to direct the projection-like portion 38*b* of the cam 38 toward the urging member 36 side thereby to push back the urging member 36, the urging member 36 is movable against the urging force of the pressing spring 37. Further, a pressure-functioning state and a pressure-released state of the fixing film 33 by the fixing film unit 34 are configured to be switched. Next, a characteristic constitution (structure) of the pressing and releasing mechanism 61 will be described.

FIGS. 3 to 5 are enlarged side views showing the structure of the pressing and releasing mechanism 61. In FIGS. 3 to 5, in order to facilitate understanding of the description of a driving method, the fixing film unit 34 and the pressing roller 31 are omitted. As shown in FIG. 3, the pressing and releasing mechanism 61 includes a motor 62 which is a "driving means". Further, the pressing and releasing mechanism 51 includes the cam 38, which is rotationally driven by the motor 62, for moving the urging member 36 in a direction in which the urging force by the urging member 36 is released or in a direction in which the urging force by the urging member 36 is restored. Further, the pressing and releasing mechanism 61 includes a swingable gear 44 which is swung depending on normal or reverse rotation of the motor 61. Further, the pressing and releasing mechanism 61 includes a swingable arm stopper 103 which is a "preventing (regulating) member" capable of transmitting a driving force of the swingable gear 44 to the cam 38 by preventing the swing of the swingable gear 44. These gears perform a characteristic operation in the pressing and releasing mechanism 61.

Although will be described later, the motor 62 which is the "driving means" and a pressing roller gear 42 which is a "fixed gear" are connected by a first gear train (third power transmitting path). To this first gear train, a shaft gear 39 and gears 40 and 41 correspond. Further, although described later, by including the swingable gear 44, the motor 62 which is the "driving means" and the cam 38 are connected by a surface gear train. The shaft gear 39, gears 40 and 43, the swingable gear 44, a gear having partly omitted teeth 45 and a gear 46 correspond to this second gear train.

Specific description will be made by including the above-described principal constituent elements. First, to the motor 62, the shaft gear 39 is attached. Further, with this shaft gear 39, a gear 101 is engaged. With the gear 102, a gear 102 is coaxially provided. Further, between the gears 101 and 102, a torque limiter function is provided. Further, with the gear 102, the swingable arm stopper 103 partly provided with gear teeth 103*a* is engaged.

On the other hand, the gear 40 is engaged with the shaft gear 39 of the motor 62. The gear 41 is engaged with the gear 40. The pressing roller gear 42 which is the "fixed gear" fixed to the pressing roller 31 is engaged with the gear 41. The pressing roller gear 42 is attached to the pressing roller 31. By such a constitution, the driving force of the motor 62 is transmitted to the pressing roller 31. The fixing film 33 can be moved by the contact with the pressing roller 31. Incidentally, here, the pressing roller gear 42 fixed to the pressing roller 31 will be described but can also be replaced with a gear attached to the fixing film 33.

On the other hand, a gear 43 is engaged with the gear 40 engaging with the shaft gear 39 of the motor 62. The swingable gear 44 is engaged with the gear 43. A swingable arm 149 is attached to a shaft of the gear 43 and a shaft of the gear 44. At an opposing position of teeth of the swingable gear 44, the gear having partly omitted teeth 45 is disposed. A gear 48 is engaged with the gear having partly omitted teeth 45. At a front surface side in FIG. 3 more than the gear 46, the gear 46 and the cam 38 are rotatably mounted. The gear 46 and the cam 38 are separate members from the gear 48 and are individually rotatable. In the case where the swingable gear 44 and the gear having partly omitted teeth 45 are engaged with each other, i.e., when the swingable gear is located at a first position, the driving force of the swingable gear 44 is transmitted to the gear having partly omitted teeth 45 and the gear 46 (first power transmitting path) and is finally transmitted to the cam 38.

For the reason described above, the drive of the pressing roller 31 and the drive of the cam 38 are effected by the same motor 62. However, the transmission of the driving force from the motor to the cam 38 is performed via a part or all of the gears 40 and 43, the swingable gear 44, the gear having partly omitted teeth 45, and the gears 46, 47 and 48 which are a "driver transmitting gear train".

With respect to the operation of the pressing and releasing mechanism 61, there are three modes described below. A "first mode" is a mode during the pressing (pressure application) between the pressing roller 31 and the fixing film 33 and is a mode during the conveyance of the sheet P. In the case of this first mode, the pressing roller gear 42 is driven and the cam is in a rest (stopped) state. A "second mode" is a mode during pressure release between the pressing roller 31 and the fixing film 33. In the case of this second mode, the pressing roller gear 42 is stopped and the cam 38 is rotated to place the pressing roller 31 and the fixing film 33 in a pressure-released state. A "third mode" is a mode during pressure restoration between the pressing roller 31 and the fixing film 33. In the case of this third mode, the pressing roller gear 42 is rotated and at the same time, the cam 38 is rotationally moved to transfer the pressing roller 31 and the fixing film 33 into a pressure-restored state. These first to third modes will be described specifically while making reference to FIGS. 3 to 5 below.

First, the first mode will be described with reference to FIG. 3. As shown in FIG. 3, the motor 62 is driven, so that the shaft gear 39 is rotated clockwise. By the clockwise rotation of the shaft gear 39, the gear 40 is rotated counterclockwise, so that the gear 43 is rotated clockwise and the swingable gear 44 is rotated counterclockwise. At the opposing position of the teeth of the swingable gear 44, the gear having partly omitted teeth 45 provided with a teeth-omitted surface 45*a* is disposed. The gear having partly omitted teeth 45 is provided with the teeth-omitted surface 45*a* where the teeth are not formed and a gear surface 45*b* where the teeth are formed. The gear having partly omitted teeth 45 is, in the case where the teeth-omitted surface 45*a* opposes the swingable gear 44, stopped since the teeth-omitted surface 45*a* cannot receive the driving force of the swingable gear 44. Thus, the driving force is blocked and therefore the cam 38 is stopped.

On the other hand, the shaft gear 39 is rotated clockwise, so that the gears 101 and 102 are rotated counterclockwise and the swingable arm stopper 103 is rotated clockwise. When the swingable arm stopper 103 is rotated in a direction of an arrow C, an end portion 103*b* of the swingable arm stopper 103 abuts against an abutment portion 149*a* formed on the swingable arm 149. The abutment portion 149*a* is formed in a recessed portion, i.e., a recess, for receiving and stopping the end portion 103*b* of the swingable arm stopper 103. A position P of the recessed portion of the swingable arm 149 is spaced from a position of a rotational movement shaft R of the swingable arm 149. (=a rotation shaft of the gear 43) more than a position of a rotation shaft Q of the swingable gear 44. By this, the swingable gear 44 can be retained at the first position with a small force. Further, a force received from the swingable arm 149 by the swingable arm stopper 103 is, as shown by an arrow in FIG. 3, designed so as to be directed toward a rotational movement shaft S of the swingable arm stopper 103. By this, deformation of the stopper 103 when the swingable arm stopper 103 receives the force from the swingable arm 149 can be suppressed. Thus, when the swingable arm stopper 103 which is the "preventing means" is rotationally moved, the swingable arm stopper 103 is moved to a prevention position J where it prevents the operation of the swingable gear 44. The prevention position J is a position taken by the swingable arm stopper 103 so that the end portion 103*b* of the swingable arm stopper 103 abuts against the abutment portion 149*a* of the swingable arm 149 to prevent the swingable gear 44 from being contacted to the gear 47. Further, by the torque limiter function provided between the gears 101 and 102, the gear 102 and the swingable arm stopper 103 are stopped.

Next, the second mode will be specifically described with reference to FIG. 4. As shown in FIG. 4, in the case where the mode is transferred from the first mode to the second mode, the motor 62 is driven, so that the shaft gear 39 is rotated counterclockwise. Even when the shaft gear 39 is rotated controller, a one-way function is incorporated into the gear 41 of the gears 40 and 41 and the pressing roller gear 42 which constitute the drive transfer gear train connected to the pressing roller 31 and therefore the pressing roller gear 42 is stopped and the fixing film 33 is stopped.

On the other hand, by the counterclockwise rotation of the shaft gear 39, the swingable gear 44 of the gears 40 and 43, the swingable gear 44, the gear having partly omitted teeth 45 and the gear 46 which constitute the drive transfer gear train is swingable. The swingable arm 149 is mounted to the swingable gear 44 so as to slightly rub the swingable gear 44 and is swung about a center shaft of the gear 43 in a direction of an arrow B. By the swing of this swingable arm 149, the swingable gear 44 and the gear 47 are engaged with each other (second position), so that the gear 47 is rotated counterclockwise and the gear 48 is rotated clockwise. When the gear 48 is rotated clockwise, the gear having partly omitted teeth 45 is rotated counterclockwise, the gear 46 is rotated clockwise, and the cam 38 is rotated counterclockwise. In this case, the gears 47 and 48 correspond to a second power transmitting path. As a result, as shown in FIG. 4, the cam 38 is rotated until an apex portion of the projection-like portion 38*b* of the cam 38 reaches a position where it contacts the urging member 36, so that the urging member 36 is moved in a right direction to result in a state in which the pressure of the fixing film 33 to the pressing roller 31 is released.

On the other hand, by the counterclockwise rotation of the shaft gear 39 of the motor 62, the gears 101 and 102 are rotated clockwise and thus the gear 102 is engaged with the teeth 103*a* and therefore the swingable arm stopper 103 is rotated in a direction of an arrow D until it abuts against the abutment portion 104. When the swingable arm stopper 103 abuts against the abutment portion 104, the gear 102 and the swingable arm stopper 103 are stopped by the torque limiter function provided between the gears 101 and 102.

Next, the third mode will be specifically described with reference to FIG. 5. As shown in FIG. 5, in the case where the mode is transferred from the second mode to the third mode, the motor 62 is driven, so that the shaft gear 39 is rotated clockwise again. When the shaft gear 39 is rotated clockwise, the gear 40 is rotated counterclockwise, the gear 43 is rotated clockwise, and the swingable gear 44 is rotated counterclockwise. As a result, the swingable gear 44 engaged with the gear 47 is swung while rotating counterclockwise, so that the swingable arm 149 is swung about the center shaft of the gear 43 is a direction of an arrow A. The swingable gear 44 approaches the gear having partly omitted teeth 45 and engages with the gear having partly omitted teeth 45 first position). The teeth-omitted surface 45*a* of the gear having partly omitted teeth 45 is, in the second mode, rotated until it is directed in an opposite direction from the swingable gear 44 and therefore the gear surface 45*b* of the gear having partly omitted teeth 45 can be engaged with the swingable gear 44. The gear having partly omitted teeth 45 is rotated clockwise, so that the gear 46 is rotated counterclockwise and the cam 38 is rotated clockwise.

On the other hand, by the clockwise rotation of the shaft gear 39, the gears 101 and 102 are rotated counterclockwise, so that the swingable arm stopper 103 is rotated in a direction of an arrow C. When the end portion 103*b* of the swingable arm stopper 103 abuts against the abutment portion 149*a*, the gear 102 and the swingable arm stopper 103 are stopped by the torque limiter function provided between the gears 101 and 102.

Based on such constitution and function in Embodiment 1, the rotation of the cam 38 progresses and when the cam 38 is rotated and moved to a certain position, the cam 38 rotates on its axis by moment thereof generated by the urging member 36. At that time, a speed of the rotation of the cam 38 on its axis by load of the moment exerted on the cam 38 by the urging member 36 becomes faster than a rotational speed at which the cam 38 is rotationally driven.

As a result, the gear 46 and the gear having partly omitted teeth 45 are also rotated by the rotation of the cam 38 on its axis, thus being rotated quickly. The swingable gear 44 receives the rotational force from the gear having partly omitted teeth 45, so that a force for moving the swingable arm 149 in the direction of the arrow B (FIG. 4) opposite from an arrow A is generated. However, the swingable arm 149 abut against the swingable arm stopper 103 and therefore the gear having partly omitted teeth 45 and the swingable gear 44 are kept in the connected state. That is, the force of the cam 38 is transmitted through the gear 46, the gear having partly omitted teeth 45, the swingable gear 44, and the gears 43 and 44 which constitute the driving train and finally retains a state in which the shaft gear 39 and the motor 62 are also connected with the driving train. As a result, even when the cam 38 will rotate quickly, by a brake of the motor 62, the motor 62 will rotate the cam 38 at a constant speed, so that it is possible to avoid the impact noise.

Embodiment 2

Parts (a) and (b) of FIG. 6 are side views showing a structure of a pressing and releasing mechanism 261 provided in an image forming apparatus according to Embodiment 2 of the present invention. Part (a) of FIG. 6 shows a state in which the pressing and releasing mechanism 261 does not urge the cam 38 by the urging member 36. Part (b) of FIG. 6 shows a state in which the pressing and releasing mechanism 261 urges the cam 38 by the urging member 36. Of constituent elements of the pressing and releasing mechanism 261 provided in the image forming apparatus in Embodiment 2, those having the same structures and effects of those of the pressing and releasing mechanism 61 in Embodiment 1 will be appropriately omitted from description by using the same reference numerals or symbols. Also in Embodiment 2, its constitution is applicable to an image forming apparatus similar to that in Embodiment 1 and therefore the description of the image forming apparatus will be omitted.

Differences of the pressing and releasing mechanism between Embodiment 2 and Embodiment 1 are that a swingable arm stopper 203 in the pressing and releasing mechanism 261 operates and functions with respect to a direction opposite from the direction in Embodiment 1 and that gears 205, 206, 207 and 245 and an abutment portion 204 are provided. Further, Embodiment 2 is also different from Embodiment 1 in that a swingable arm 249 operates and functions with respect to a direction opposite from that in Embodiment 1. However, the swingable arm stopper 202 is similar to the case of the swingable arm stopper 103 in Embodiment 1 in that when the swingable arm stopper 203 which is a "preventing member" in Embodiment 2 is rotationally moved, the swingable arm stopper 203 is moved to a prevention position J ((b) of FIG. 6) where it prevents the operation of the swingable gear 44. The prevention position J is a position taken by the swingable arm stopper 203 so that an end portion 203*b* of the swingable arm stopper 203 abuts against an abutment portion 249*a* of the swingable arm 249 to prevent the swingable gear 44 from being contacted to the gear 47. In Embodiment 1, both of the first power transmitting path and the second power transmitting path were the path through which the power of the motor was transmitted to the cam. On the other hand, in the case of Embodiment 2, the first power transmitting path (the gear 245, the gear 46 and the cam 38) is a path through which the power is transmitted to the cam, and the second power transmitting path (the gear 47, the gear 205, the gear 206 and the gear 207) is a path through which the pressing roller is driven. Part (a) of FIG. 6 is the side view in the case where the swingable gear 44 is located at the second position. Part (b) of FIG. 6 is the side view in the case where the swingable gear 44 is located at the first position.

By including the swingable gear 44, the motor 62 which is the "driving means" and the pressing roller gear 42 which is the "fixed gear" are connectable by a first gear train. The shaft gear 39, the gears 40 and 43, the swingable gear 44, and the gears 47, 205, 206 and 207 correspond to the first gear train. By including the swingable gear 44, the motor 62 which is the "driving means" and the cam 38 is connectable by a second gear train. The shaft gear 39, the gears 40 and 43, the swingable gear 44, the gear 245 and the gear 46 correspond to the second gear train.

A characteristic constitution in Embodiment 2 will be described. The gear 101 is connected with the shaft gear 39 of the motor 62. The gear 102 is the gear coaxial with the gear 101, and the torque limiter function is provided between the gears 101 and 102. To the gear 102, the swingable arm stopper 203 partly provided with a gear tooth 203*a* is connected.

Next, an operation will be described. In Embodiment 2, there are two operation modes. A first mode is a mode during pressure application of the fixing film 33 to the pressing roller 31 and is a mode during conveyance of the sheet P, and is a state in which the pressing roller gear 42 is driven and the cam 38 is stopped. A second mode is a mode during release of the pressure application of the fixing film 33 to the pressing roller 31 and is a state in which the pressing roller gear 42 is stopped and the cam 38 is rotationally moved.

Details of the first mode will be described by using (a) of FIG. 6. In (a) of FIG. 6, the shaft gear 39 of the motor 62 is rotated counterclockwise. The pressing roller gear 42 is rotated and driven by the gears 40 and 43, the swingable gear 44 and the gears 47, 205, 206 and 207 which are the drive transmitting gear train connected from the shaft gear 39 of the motor 62 to the fixing film 33. Further, from the shaft gear 39 of the motor 62 to the cam 38, the drive is transmitted through the gears 40 and 43, the swingable gear 44 and the gears 245 and 46 which are the drive transfer gear train, but the swingable gear 44 and the gear 245 are spaced from each other, so that the cam 38 is stopped.

To the swingable arm stopper 203, the drive is transmitted through the gears 101 and 102, the swingable arm stopper 203 is rotated in a direction of an arrow D until it abuts against the abutment portion 204. When the swingable arm stopper 203 abuts against the abutment portion 204, the gear 102 and the swingable arm stopper 203 are stopped by the torque limiter function provided between the gears 101 and 102.

Next, details of the second mode will be described by using (b) of FIG. 6. When the mode is transferred from the first mode to the second mode, the shaft gear 39 of the motor 62 is rotated reversely, i.e., is rotated clockwise in (b) of FIG. 6. The gear 40 is rotated counterclockwise, and the gear 43 is rotated clockwise. The swingable arm 249 is mounted to the swingable gear 44 so as to slightly rub the swingable gear 44, so that the swingable arm 249 is swung about the center shaft of the gear 43 in the arrow A direction. As a result, the swingable gear 44 and the gear 47 are spaced from each other and therefore the gears 47, 205, 206 and 207 and the pressing roller gear 42 are stopped, so that the pressing roller 31 is stopped. With respect to the cam 38, the drive is transmitted through the gears 40 and 43, the swingable gear 44 and the gears 245 and 46 which are the drive transfer gear train, and finally the cam 38 is rotated clockwise to the position shown in (b) of FIG. 6, so that the urging member 36 is moved to result in the pressure-released state.

The driving force is transmitted to the swingable arm stopper 203 through the gears 101 and 102, so that the swingable arm stopper 203 is rotated in the arrow C direction until the end portion 203*b* abuts against the abutment portion 249*a* provided to the swingable arm 249. When the end portion 203*b* of the swingable arm stopper 203 abuts against the abutment portion 249*a*, the gear 102 and the swingable arm stopper 203 are stopped by the torque limiter function provided between the gears 101 and 102. In order to restore the pressing and releasing mechanism 261 to the pressure application state, the operation in the second mode is continued, so that the shaft gear 39 of the motor 62 is rotationally driven to the position shown in (a) of FIG. 6.

Based on such constitution and function in Embodiment 2, the rotation of the cam 38 progresses and when the cam 38 is rotated and moved to a certain position, the cam 38 rotates on its axis by moment thereof generated by the urging member 36. At that time, a speed of the rotation of the cam 38 on its axis by load of the moment exerted on the cam 38 by the urging member 36 becomes faster than a rotational speed at which the cam 38 is rotationally driven.

As a result, the gear 46 and the gear 245 are also rotated by the rotation of the cam 38 on its axis, thus being rotated quickly. The swingable gear 44 receives the rotational force from the gear 245, so that a force for moving the swingable arm 249 in the direction of the arrow B ((b) of FIG. 6) opposite from an arrow A is generated. However, the swingable arm 249 abuts against the swingable arm stopper 203 and therefore the gear 245 and the swingable gear 44 are kept in the connected state. That is, the force of the cam 38 is transmitted through the gear 46, the gear 245, the swingable gear 44, and the gears 43 and 44 which constitute the driving train and finally retains a state in which the shaft gear 39 and the motor 62 are also connected with the driving train. As a result, even when the cam 38 will rotate quickly, by a brake of the motor 62, the motor 62 will rotate the cam 38 at a constant speed, so that it is possible to avoid the impact noise.

Embodiment 3

Parts (a) and (b) of FIG. 7 are side views showing a structure of a pressing and releasing mechanism 361 provided in an image forming apparatus according to Embodiment 3 of the present invention. Part (a) of FIG. 7 shows a state in which a swingable arm stopper 303 abuts against a swingable arm 349. Part (b) of FIG. 7 shows a state in which the swingable arm stopper 303 does not abut against the swingable arm 349. Of constituent elements of the pressing and releasing mechanism 361 provided in the image forming apparatus in Embodiment 3, those having the same structures and effects of those of the pressing and releasing mechanism 61 in Embodiment 1 will be appropriately omitted from description by using the same reference numerals or symbols. Also in Embodiment 3, its constitution is applicable to an image forming apparatus similar to that in Embodiment 1 and therefore the description of the image forming apparatus will be omitted.

A differences of the pressing and releasing mechanism 361 in Embodiment 3 from the pressing and releasing mechanism 61 in Embodiment 1 is that a swingable arm stopper 303 is operated by a solenoid 308 in the pressing and releasing mechanism 361 to create an engaged state and an unengaged state with the swingable arm 349. Further, Embodiment 3 is also different from Embodiment 1 in that when the swingable arm stopper 303 which is a "preventing means" in the pressing and releasing mechanism 351 is linearly operated, the swingable arm stopper 303 is moved to a prevention position K where it prevents the operation of the swingable gear 44. The prevention position K is a position taken by the swingable arm stopper 303 so that an end portion 303*b* of the swingable arm stopper 303 abuts against an abutment portion 349*a* of the swingable arm 349 to prevent the swingable gear 44 from being contacted to the gear 47.

Although will be described later, the motor 62 and a pressing roller gear 42 are connected by a first gear train. To this first gear train, a shaft gear 39 and gears 40 and 41 correspond. Further, although described later, by including the swingable gear 44, the motor 62 and the cam 38 are connected by a surface gear train. The shaft gear 39, gears 40 and 43, the swingable gear 44, a gear having partly omitted teeth 45 and a gear 46 correspond to this second gear train.

FIG. 3 will be described with reference to (a) and (b) of FIG. 7. Further, the same constitution as those in comparative embodiments and already-described Embodiment 1 or 2 quotes those constitutions in support thereof and will be omitted from description. The controller of the drive of the fixing film 33 and the drive of the cam 38 is similar to that in Embodiment 1 or 2. Embodiment 3 is characterized in the constitution of the swingable arm stopper 303 and therefore the description will be made by being limited to the operation of the swingable arm stopper 303.

The swingable arm stopper 303 is constituted so as to produce linear motion. The swingable arm stopper 303 is provided with an elongated hole 303*a* and is supported linearly movably by two fixed shafts 306 and 307. To one end of the swingable arm stopper 303, an electromagnetic solenoid 308 is connected, so that the swingable arm stopper 303 effects the linear motion in interrelation with the operation of the electromagnetic solenoid 308. As shown in (a) of FIG. 7, when the electromagnetic solenoid 308 is pressed, the swingable arm stopper 303 abuts against the abutment portion 349*a* of the swingable arm 349 to prevent the operation of the swingable arm 349. As shown in (b) of FIG. 7, when the electromagnetic solenoid 308 is pulled, the swingable arm 349 is not prevented and therefore is movable to the position shown in (b) of FIG. 7.

Parts (a) and (b) of FIG. 8 are side views showing the structure of the pressing and releasing mechanism 361. These (a) and (b) of FIG. 8 show a state in which the structure of the cam 38 in Embodiments 1 and 2 is added to the structure specifically described with reference to (a) and (b) of FIG. 7. The cam 38 is disposed at the front side in the drawing sheet surface of (a) and (b) of FIG. 8 more than the swingable arm stopper 303.

In the image forming apparatuses in Embodiments 1 to 3 described above, the operations of the pressure release and pressure restoration of the fixing device are performed by the cam 38, and the rotational movement controller of the cam 38 is effected by the normal and reverse rotation of the motor 62 and by the swing of the swingable gear 44 in synchronism with the normal and reverse rotation of the motor 62. Further, when the cam 38 will rotate quickly, the swingable arm stopper 303 which is the "preventing means" functions so as not to move the swingable gear 44, so that the cam 38 and the motor are always connected and thus the cam 38 can be rotationally moved at a constant speed. Further, by rotationally moving the cam 38 at the constant speed, the impact noise is reduced.

That is, a phenomenon that during the transition between the gear engagement state in the nip-released state by the fixing film 33 and the gear engagement state during the nip function by the fixing film 33, the gears free from the engagement are rotated quickly to generate the impact noise is suppressed.

Part (a) of FIG. 9 is a side view showing a structure of a pressing and releasing mechanism 461 provided in an image forming apparatus according to the comparative embodiment. Part (a) of FIG. 9 shows a state of a first mode in which the pressing roller gear 42 is rotated and the cam 38 is stopped. While making reference to this (a) of FIG. 9 and (b) of FIG. 9 which is described later, the case where the swingable arm stopper which is the "preventing means" is not present will be specifically described below. First, the first mode will be described. In (a) of FIG. 9, the shaft gear 39 rotates clockwise. The pressing roller gear 42 is rotationally driven by the gears 40 and 41 which are the drive transmitting gear train connected from the shaft gear 39 to the fixing film 33. Further, from the shaft gear 39 to the cam 38, the path is connected by the gears 40 and 43, the swingable gear 44, a gear having partly omitted teeth 445 and the gear 46 which are the drive transfer gear train. Of these, the gear having partly omitted teeth 445 is provided with a teeth-omitted surface 445*a*.

The driving force to the gear having partly omitted teeth 445 is blocked since the teeth-omitted surface 445*a* of the gear having partly omitted teeth 445 is stopped at a phase where it does not receive the driving force of the swingable gear 44, so that the cam 38 is stopped.

Part (b) of FIG. 9 is a side view showing the structure of the pressing and releasing mechanism 461 provided in the image forming apparatus according to the comparative embodiment. Part (b) of FIG. 9 shows a state of a second mode in which the pressing roller gear 42 is stopped and the cam 38 is rotated. The second mode will be specifically described while making reference to (b) of FIG. 9. When the mode is transferred from the first mode to the second mode, the shaft gear 39 is reversely rotated, thus being rotated counterclockwise in (b) of FIG. 9. The one-way function is incorporated into the gear 41 of the gears 40, 41 and 42 which are the drive transfer gear train connected from the shaft gear 39 to the pressing roller 31. For that reason, the pressing roller gear 42 is stopped, i.e., the pressing roller 31 is also stopped. In the path from the shaft gear 39 to the cam 38, the swingable gear 44 of the gears 40 and 43, the swingable gear 44, the gears 47 and 48, the gear having partly omitted teeth 445 and the gear 46 which are the drive transfer gear train is swingable. A swingable arm 49 is mounted to this swingable gear 44 so as to slightly rub the swingable gear 44, so that the swingable arm 49 is swung in the arrow B direction. As a result, the swingable gear 44 and the gear 47 are engaged with each other to rotate the gear 48 clockwise. As a result, the gear having partly omitted teeth 445 and the gear 46 are rotationally driven, and finally the cam 38 is rotated counterclockwise to the position shown in (b) of FIG. 9, so that the urging member 36 is moved to result in the pressure-released state.

Part (a) of FIG. 10 is a side view showing a structure of a pressing and releasing mechanism 461 provided in an image forming apparatus according to the comparative embodiment. Part (a) of FIG. 10 shows a state of a third mode in which both of the pressing roller gear 42 and the cam 38 are rotated. First, the third mode will be specifically described while making reference to (a) of FIG. 10. When the mode is transferred from the second mode to the third mode, the shaft gear 39 is reversely rotated again, i.e., is rotated clockwise in (a) of FIG. 10. As a result, the swingable gear 44 previously engaged with the gear 47 is engaged with the gear having partly omitted teeth 445 by the swing of the swingable arm 49 about the center shaft of the gear 43 in the arrow A direction. The teeth-omitted surface 445*a* of the gear having partly omitted teeth 445 is, during the operation in the second mode, moved to the position shown in (b) of FIG. 9, so that the drive transmission to the cam 38 is effected. Then, the cam 38 is rotationally moved to a position (state shown in (a) of FIG. 9) where the swingable gear 44 and the teeth-omitted surface 445*a* coincide with each other, thus being returned to an initial position, so that the fixing film 33 and the fixing film unit 34 are restored to the pressure-applied state.

Part (b) of FIG. 10 is a side view showing the structure of the pressing and releasing mechanism 461 provided in the image forming apparatus according to the comparative embodiment. Part (b) of FIG. 10 shows a state of a third mode in which both of the pressing roller gear 42 and the cam 38 are rotated. The third mode will be specifically described while making reference to (b) of FIG. 10. In the above-described third mode, the cam 38 and the parts operating in interrelation with the cam 38 are rotated faster than those during normal drive by the force of the urging member 36 in some cases, and as a result, the impact noise is generated. With respect to the cause thereof, the following situation would be considered. Part (b) of FIG. 10 shows a state in which the rotational movement of the cam 38 progresses from the state of (a) of FIG. 10, and when the states of (a) of FIG. 10 and (b) of FIG. 10 are compared, "moment of cam 38 in state of (a) of FIG. 10=F1×r1"<"moment of cam 38 in state of (b) of FIG. 10=F2×r2" is satisfied. That is, in the mode in which the state is restored from the pressure-released state to the pressure-applied state, the cam 38 is rotationally moved in a direction in which the movement of the cam 38 is gradually increased.

Further, when the cam 38 is rotationally moved to a certain position, the cam 38 rotates on its axis by moment thereof generated by the urging member 36. Assuming that this condition is the position shown in (b) of FIG. 10, a rotational speed v2 (state of (b) of FIG. 10) of the cam 38 on its axis by the moment of the cam 38 generated by the urging member 36 becomes faster than a rotational speed v1 (state of (a) of FIG. 10) of the driving gear train for rotationally driving the cam 38. As a result, the gear 46 and the gear having partly omitted teeth 445 are also rotated by the rotation of the cam 38 on its axis, thus being rotated quickly. The swingable gear 44 receives the rotational force from the gear having partly omitted teeth 445, with the result that the 49 is moved in the direction of the arrow B and thus the gear having partly omitted teeth 445 and the swingable gear 44 are spaced from each other.

In the state in which the gear having partly omitted teeth 445 and the swingable gear 44 are spaced from each other, the gear 46 and the gear having partly omitted teeth 445 which are the drive gear train connected to the cam 38 is in a state close to a no-load state and therefore the cam 38 is rotated to the initial position (state of (b) of FIG. 9) where a balance of the forces is achieved. By this series of the operations, the pressing spring 37, the urging member 36, the cam 38, the gear 46 and the gear having partly omitted teeth 445 which are the parts which operate or rotates more quickly than those during the normal drive are abruptly stopped when the balance is achieved, and at that time, there is a possibility that the impact noise is generated. In recent years, noise reduction is further required but in the apparatus in the comparative embodiment, it would be considered that the suppression of the generation of the impact noise is not realized.

INDUSTRIAL APPLICABILITY

According to the present invention, in the fixing device, the pressing and releasing mechanism can be utilized for superposing the phenomenon that the impact noise is generated, by the quick rotation of the gears free from the engagement, in the transition process between the gear engagement state in the nip-released state by the pressing member and the gear engagement state during the nip function by the pressing member.

The invention claimed is:

1. A fixing device comprising:

a rotatable member for conveying a recording material for carrying an image;

a back-up member for forming a fixing nip, together with said rotatable member, in which the image is to be fixed on the recording material;

a pressure-applying mechanism for applying pressure to the fixing nip;

a cam for releasing the pressure applied to the fixing nip by acting on said pressure-applying mechanism;

a motor, capable of rotating normally and reversely, for driving said cam;

a first power transmitting path for permitting transmission of power of said motor;

a second power transmitting path for permitting transmission of the power of said motor;

a swingable gear for transmitting the power of said motor to said first power transmitting path or said second power transmitting path;

a swingable arm for holding said swingable gear; and a preventing member for preventing movement of said swingable arm by being engaged with said swingable arm, wherein of said first power transmitting path and said second power transmitting path, at least said first power transmitting path is a path for permitting transmission of the power of said motor to said cam, wherein when said motor rotates in one direction, said swingable arm is tilted so that said swingable gear is moved to a first position for permitting transmission of the power of said motor to said first power transmitting path, and when said motor rotates in the other direction, said swingable arm is tilted so that said swingable gear is moved to a second position for permitting transmission of the power of said motor to said second power transmitting path, and wherein when said swingable gear is located at the first position, said preventing member engages with said swingable arm so that said swingable gear is prevented from moving from the first position, and when said swingable gear is located at the second position, said preventing member is spaced from said swingable arm.

2. A fixing device according to claim 1, wherein said preventing member is moved, by the power of said motor, to a position where it engages with said swingable arm and a position where it is spaced from said swingable arm.

3. A fixing device according to claim 1, wherein said preventing member is moved by power different from that of said motor, to a position where it engages with said swingable arm and a position where it is spaced from said swingable arm.

4. A fixing device according to claim 1, wherein said second power transmitting path is also a path for permitting the transmission of the power of the motor to said cam.

5. A fixing device according to claim 1, wherein said second power transmitting path is a path for permitting transmission of the power of the motor to said rotatable member.

* * * * *